US012606393B2

(12) United States Patent
Jaquemet et al.

(10) Patent No.: US 12,606,393 B2
(45) Date of Patent: Apr. 21, 2026

(54) FEEDER WITH MOVING BELT

(71) Applicant: BOBST MEX SA, Mex (CH)

(72) Inventors: Gaël Jaquemet, Ropraz (CH); Arnaud Dekervel, Allinges (FR)

(73) Assignee: BOBST MEX SA, Mex (CH)

( * ) Notice: Subject to any disclaimer, the term of this patent is extended or adjusted under 35 U.S.C. 154(b) by 0 days.

(21) Appl. No.: 18/911,482

(22) Filed: Oct. 10, 2024

(65) Prior Publication Data

US 2025/0122038 A1 Apr. 17, 2025

(30) Foreign Application Priority Data

Oct. 13, 2023 (EP) ..... 23203599

(51) Int. Cl.
*B65H 3/04* (2006.01)
*B65H 3/12* (2006.01)

(52) U.S. Cl.
CPC ..... *B65H 3/042* (2013.01); *B65H 3/126* (2013.01); *B65H 2403/20* (2013.01); *B65H 2403/50* (2013.01); *B65H 2406/32* (2013.01); *B65H 2801/21* (2013.01)

(58) Field of Classification Search
CPC .... B65H 3/042; B65H 3/126; B65H 2403/20; B65H 2403/50
See application file for complete search history.

(56) References Cited

U.S. PATENT DOCUMENTS 4,494,745 A * 1/1985 Ward, Sr. ..... B65H 3/04 271/99
5,026,040 A * 6/1991 Gibert ..... B65H 3/042 271/99
5,074,539 A * 12/1991 Wells ..... B65H 3/126 271/99
5,464,202 A * 11/1995 Capdeboscq ..... B65H 3/126 271/99
5,531,432 A * 7/1996 Sardella ..... B65H 5/023 271/12
6,164,432 A * 12/2000 Monsees ..... B65H 3/042 271/305
6,607,193 B2 * 8/2003 Nordling ..... B65H 3/126 271/99
7,635,124 B2 * 12/2009 Sardella ..... B65H 3/126 271/99
9,162,834 B1 * 10/2015 Lee ..... B65H 3/126

FOREIGN PATENT DOCUMENTS

DE 3320491 A1 1/1984
DE 10219982 C1 7/2003
EP 2408698 B1 1/2012

* cited by examiner

*Primary Examiner* — Patrick Cicchino
(74) *Attorney, Agent, or Firm* — Bookoff McAndrews, PLLC

(57) ABSTRACT

The present invention relates to a feeder module for discharging sheets into a converting machine. The feeder module comprises a movable discharge conveyor comprising a plurality of belt conveyors which are configured to move between a discharge position (DP) in which the belt conveyors are contacting the lowermost positioned sheet in the stack and discharges said sheet, and a clearing position (CP) in which the conveyor belts are located underneath the loading surface.

7 Claims, 9 Drawing Sheets

FEEDER WITH MOVING BELT

CROSS-REFERENCE TO RELATED APPLICATION(S)

This patent application claims the benefit of priority to European Application No. 23203599.8, filed on Oct. 13, 2023, the entirety of which is incorporated herein by reference.

FIELD OF THE INVENTION

The present invention relates to a feeder module for a converting machine, such as a rotary printing press or a converting machine configured to print and cut sheets to produce packaging elements. The invention may also relate to a digital printing machine.

BACKGROUND

Converting machines are used in the production of packaging elements such as flat-packed and folding boxes.

Sometimes, the same converting machine is configured to print, cut and crease, and fold the sheet to form a packaging element.

However, it is also common to use several types of converting machines when producing a packaging element. For instance, a first machine in the form of a printing press will print the sheet, a second machine in the form of a die-cutting machine will shape the sheet to a cut-to-shaped blank (also referred to as a flat-packed box). Alternatively, a folder-gluer converting machine may glue and fold the blank to form a folding box.

A common module for most converting machines is a feeder module. The feeder module comprises a loading surface onto which a stack of sheets or cut-to-shaped blanks can be placed. The feeder is configured to discharge the sheets or blanks one by one into the converting machine at a precise timing.

Some feeder modules comprise a movable loading surface which displaces the stack up and down such that the pile is engaged and disengaged from drive belts or rollers in the feeder. The feeder is further provided with a gauge which only allows one sheet to enter into the converting machine at a time.

The feeder is often provided with a rear bar configured to support part of the stack. Instead of moving the loader surface linearly up and down, a pivoting movement can be provided by applying the lifting force at a position at the rear of the stack.

However, this solution has an effect of lifting the rear ends of the sheets to a position which is higher that the vertical tip of the gauge. This may lead to scratching the top side of the sheets as they are passed under the tip of the gauge.

SUMMARY

It is an object of the present invention to alleviate the above-mentioned drawbacks of the prior art.

This object is solved by a feeder module according to claim 1.

According to an aspect of the present invention, there is provided a feeder module for discharging sheets into a converting machine. The feeder module comprises a loading surface configured to receive a stack of sheets, and a movable discharge conveyor comprising a plurality of belt conveyors.

The belt conveyors each comprise an upper contact surface which is in contact with the sheets, and wherein the belt conveyors are configured to move between a discharge position in which the belt conveyors are contacting the lowermost positioned sheet in the stack and discharges said sheet, and a clearing position in which the conveyor belts are located underneath the loading surface The invention is based on a realization that a more precise discharge of sheets can be provided by a vertical movement of the discharge conveyor.

Within the context of this application, the term "converting machine" includes machines which are only configured to print a sheet substrate and converting machines which further comprise cutting and shaping modules such as rotary die-cutters, slotting modules and folding modules, or flatbed die-cutters.

In an embodiment, each of the belt conveyors is guided by a motorized drive roller and an idle roller, wherein the motorized rollers are mounted to a drive shaft.

In an embodiment, the drive shaft comprises a first drive shaft member and a second drive shaft member, and wherein a first group of belt conveyors are connected to the first drive shaft member and a second group of belt conveyors are connected to the second drive shaft member.

The first and second drive shaft members may be connected to a common motor. The motor may be located under the loading surface and in the center of the loading surface.

Preferably, the belt displacement member is arranged between the drive roller and the idle roller, and wherein the belt displacement member is configured to move the belt conveyor up and down in the vertical direction. Hence, the belt displacement member may be restricted to a vertical displacement. That is without any horizontal displacement component.

In an embodiment, the displacement member is arranged inside a loop formed by the belt conveyor and wherein the displacement member is configured to contact an inner periphery of the belt conveyor.

In an embodiment, belt displacement member comprises an upper displacement surface configured to move the contact surface of the conveyor belt and a lower displacement surface configured to move the return portion of the belt conveyor belt.

In an embodiment, the upper displacement surface is provided with apertures.

Preferably, the upper and lower displacement surfaces are provided with a sliding surface configured to contact the inner periphery of the belt conveyor.

In an embodiment, the belt displacement member is connected to a second drive mechanism, and wherein the second drive mechanism comprises a second motor and a timed mechanism. The timed mechanism may comprise an eccentric drive shaft.

In an embodiment, the feeder module according to the preceding claim, wherein the feeder module comprises a suction box provided with a plurality of suction compartments, and wherein the first and second drive shaft members are located in the suction box, and wherein the suction compartments are symmetrically arranged in relation to a center axis of the loading surface.

BRIEF DESCRIPTION OF THE DRAWINGS

The invention will now be described with reference to the appended drawings, in which like features are denoted with the same reference numbers and in which.

DETAILED DESCRIPTION

General Description of a Masterflex, DRO and FFG Machines

Figure 1:
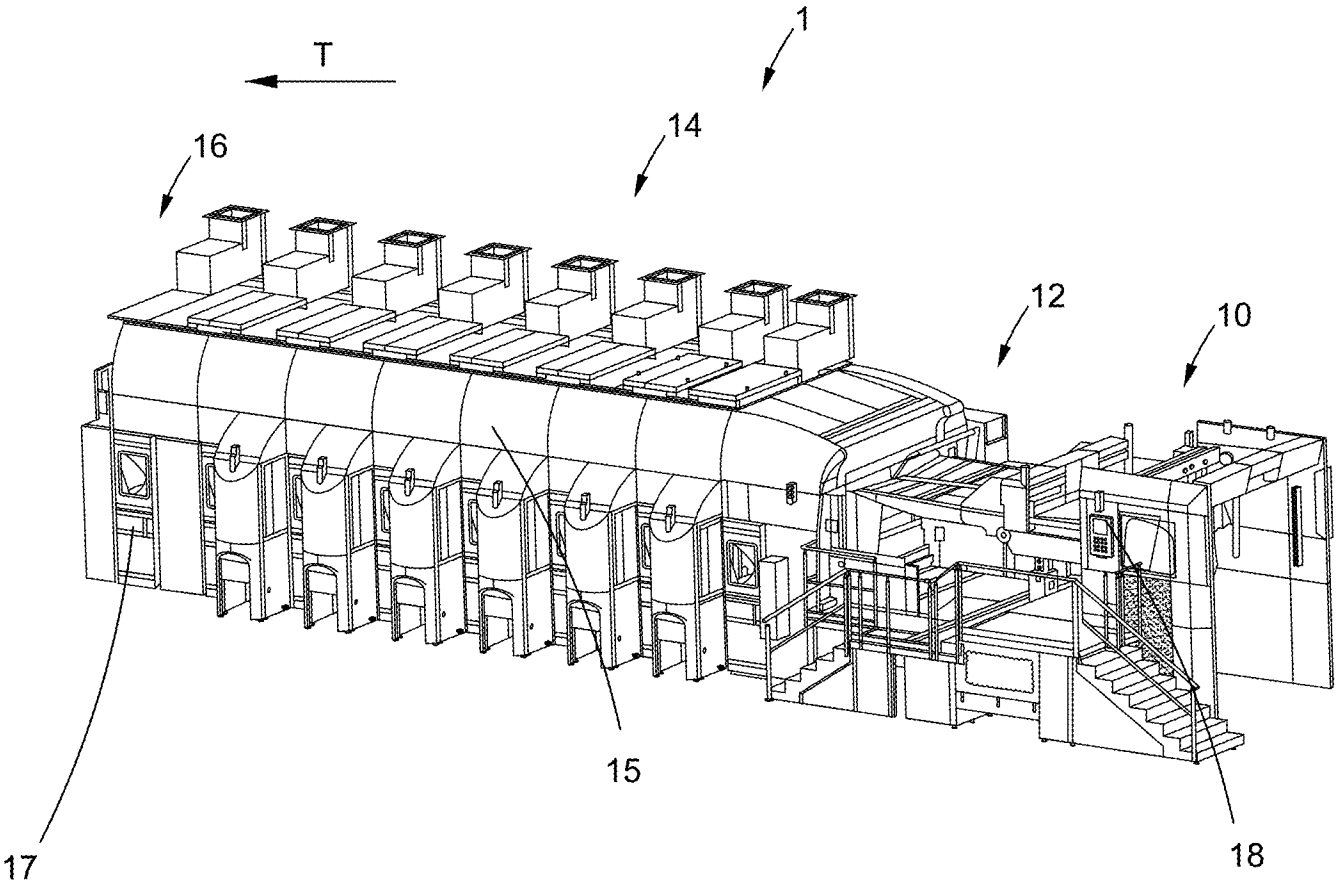
FIG. 1 is a schematic perspective view of a converting machine in the configuration of a flexographic printing press.

Referring to the figures and in particular to FIG. 1 which illustrates a converting machine 1 in the form of printing press machine. Even if not illustrated, the present invention can be used for other converting machines such as flatbed die-cutters, rotary die cutters or flexo-folder gluers which further comprise a converting unit comprising a slotter assembly or a rotary-die cutting assembly. These machines may be provided with the same feeder module which will be described in the following.

As illustrated in FIG. 1, the converting machine may comprise successively in a direction of transportation T: a loader 10 for automatically loading stacks of sheets 2, a feeder 12, a printing module 14 comprising plurality of printing units 15, and a delivery module 16 which may include a stacker device 17. Optionally, the converting machine 1 may further comprise a digital printing module (not illustrated).

A main operator interface 18 may also be provided in the proximity of the converting machine. The converting machine 1 may also comprise a bundler and a palletizer module.

Figure 2A:
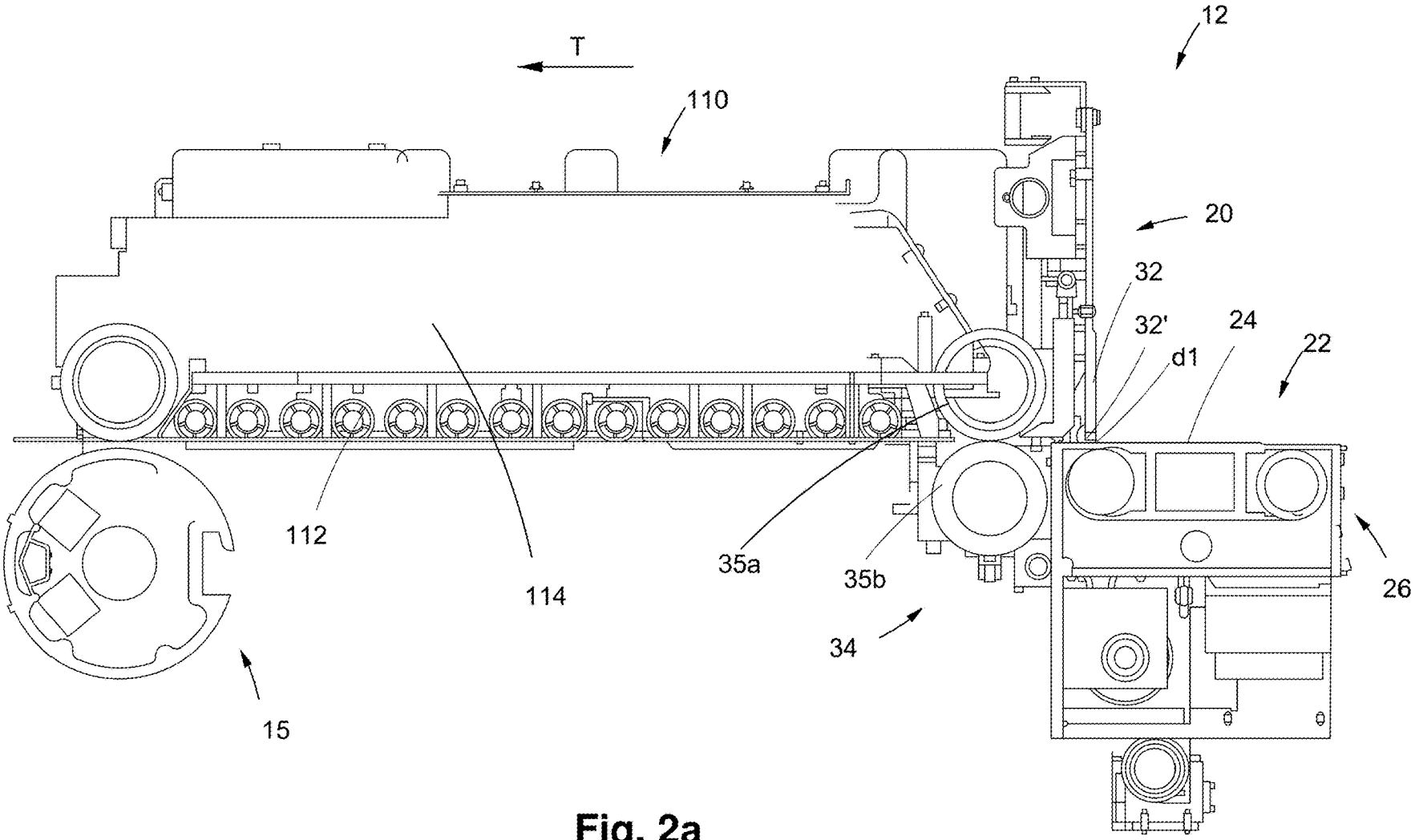
FIG. 2*a* is a schematic cross-sectional view of a feeder module according to an embodiment of the present invention.
Figure 2B:
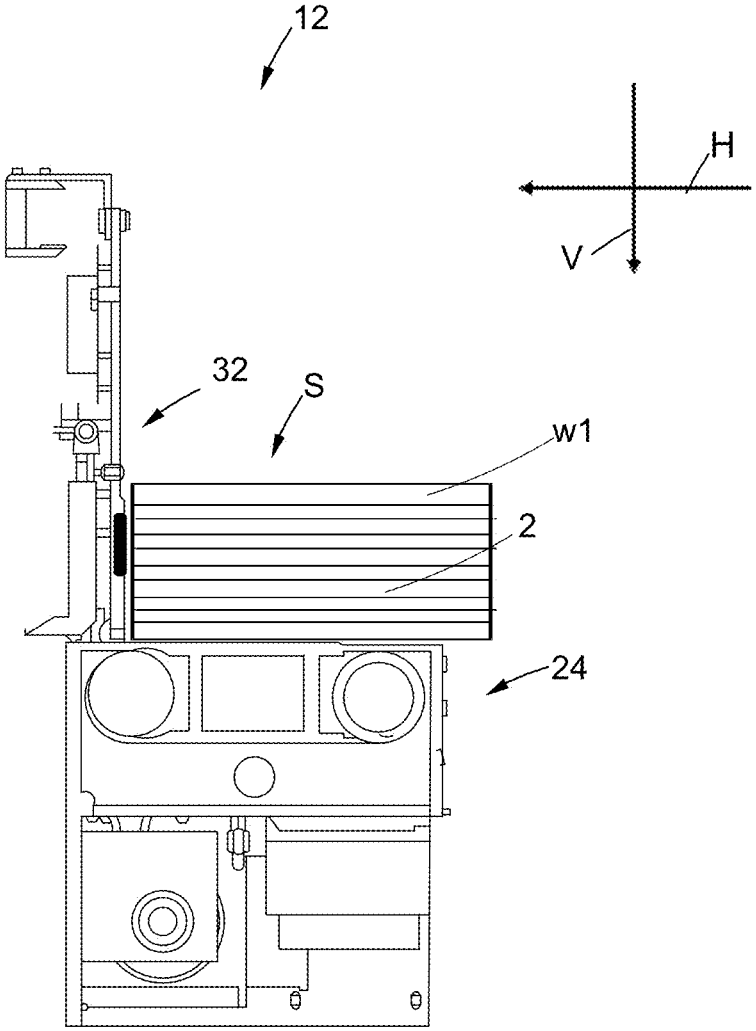
FIG. 2*b* is a detailed view of a stack of sheets on a loading surface of a feeder module.

As illustrated in FIGS. 2*a* and 2*b*, the feeder module comprises an upper feeder assembly 20 and a lower feeder assembly 22. The upper feeder assembly 20 and the lower feeder assembly 22 are mounted to a common module frame.

The lower feeder assembly 22 comprises a loading surface 24 and a sheet discharge mechanism 26. The loading surface 24 is configured to receive a stack S of sheets 2 and the sheet discharge mechanism 26 is configured to discharge the sheets 2 one by one into the converting machine 1 in the direction of transportation T. The sheet discharge mechanism 26 comprises a plurality of belt conveyors 30 arranged side by side.

The upper feeder assembly 20 comprises a gauge 32. The gauge 32 has a distal vertical end 32' which is arranged at distance d1 from the loading surface 24. The distance d1 between the distal vertical end 32' and the loading surface 24 defines a clearance through which the lowermost positioned sheet 2 in the stack S can pass.

The feeder module 12 further comprises a feeder roll assembly 34. The feed roll assembly 34 is located on a downstream side of the gauge 32 and is configured to grasp each sheet 2 to pull the sheet 2 from the loading surface 24. The feed roll assembly 34 comprises an upper feed roller 35*a* and a lower feed roller 35*b*.

Figure 3A:
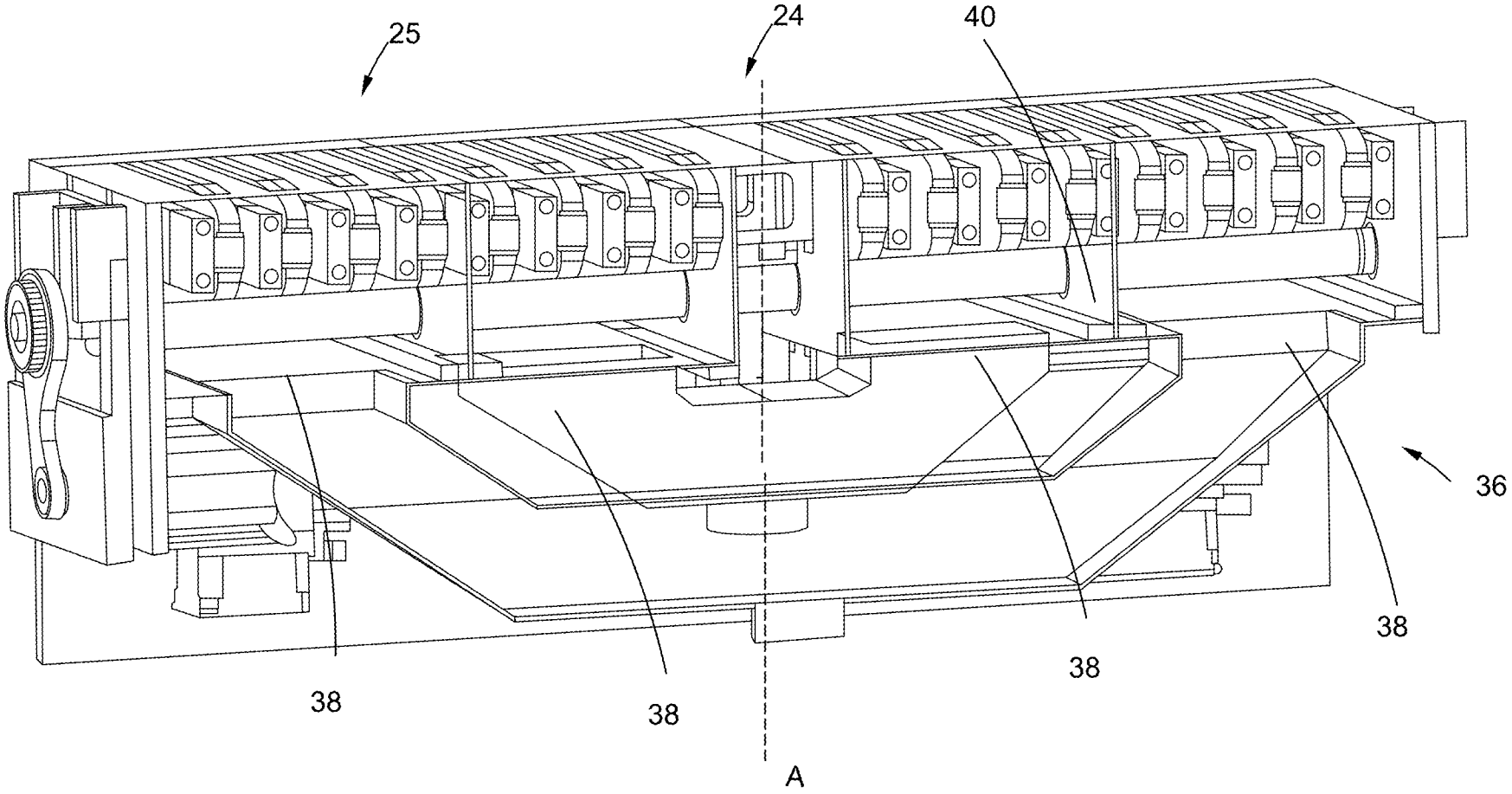
FIG. 3*a* is a schematic cross-sectional view of a loading surface of the feeder module of FIG. 2.
Figure 3B:
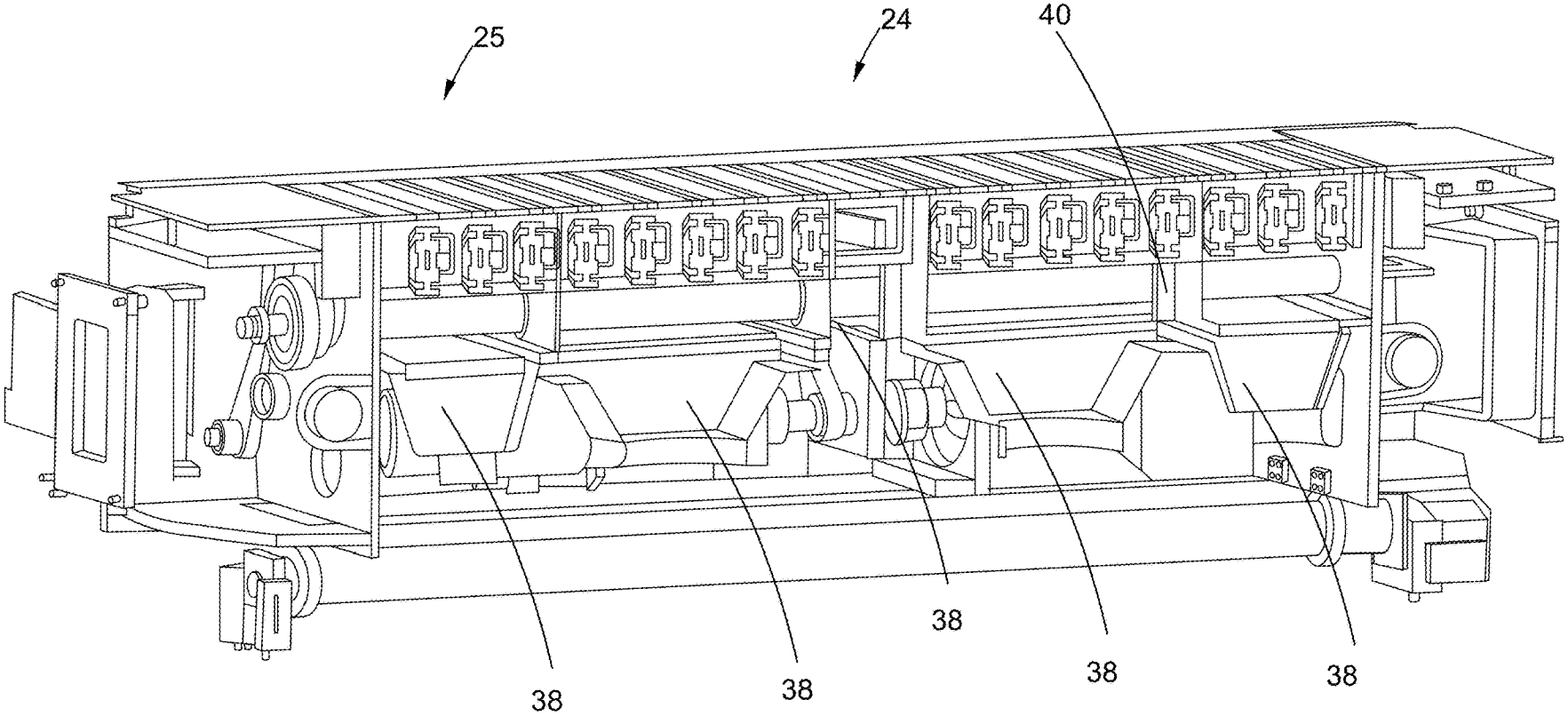
FIG. 3*b* is a schematic cross-sectional view of another embodiment of a loading surface of the feeder module of FIG. 2.

As best seen in FIGS. 3*a* and 3*b*, the belt conveyors 30 may be arranged in a suction box 36. The suction box 36 may comprise a plurality of compartments 38. The compartments 38 may be separated from each other by partition walls 40. Preferably, the partition walls 40 are arranged such that the suction compartments 38 are symmetric in relation to a center axis A of the loading surface 24. In an embodiment, there may be two suction compartments 38, 38 located on each side of the center axis A. Each suction compartment 38, 38 may be connected to a separate vacuum pump (not illustrated). In another embodiment, there may be three suction compartments, in the form of a central suction compartment 38, a first suction compartment 38 and a second suction compartment 38. The central suction compartment 38 may be connected to a first suction pump and the first and the second lateral suction boxes may be both connected to a second suction pump.

The loading surface 24 is a flat surface which is configured to receive stacks S of sheets 2. The loading surface 24 is attached to a chassis of the feeder module. The stack of sheets S can be placed on the loading surface 24 by a loader module 10 as the one described in document EP2408698B1.

Figure 5:
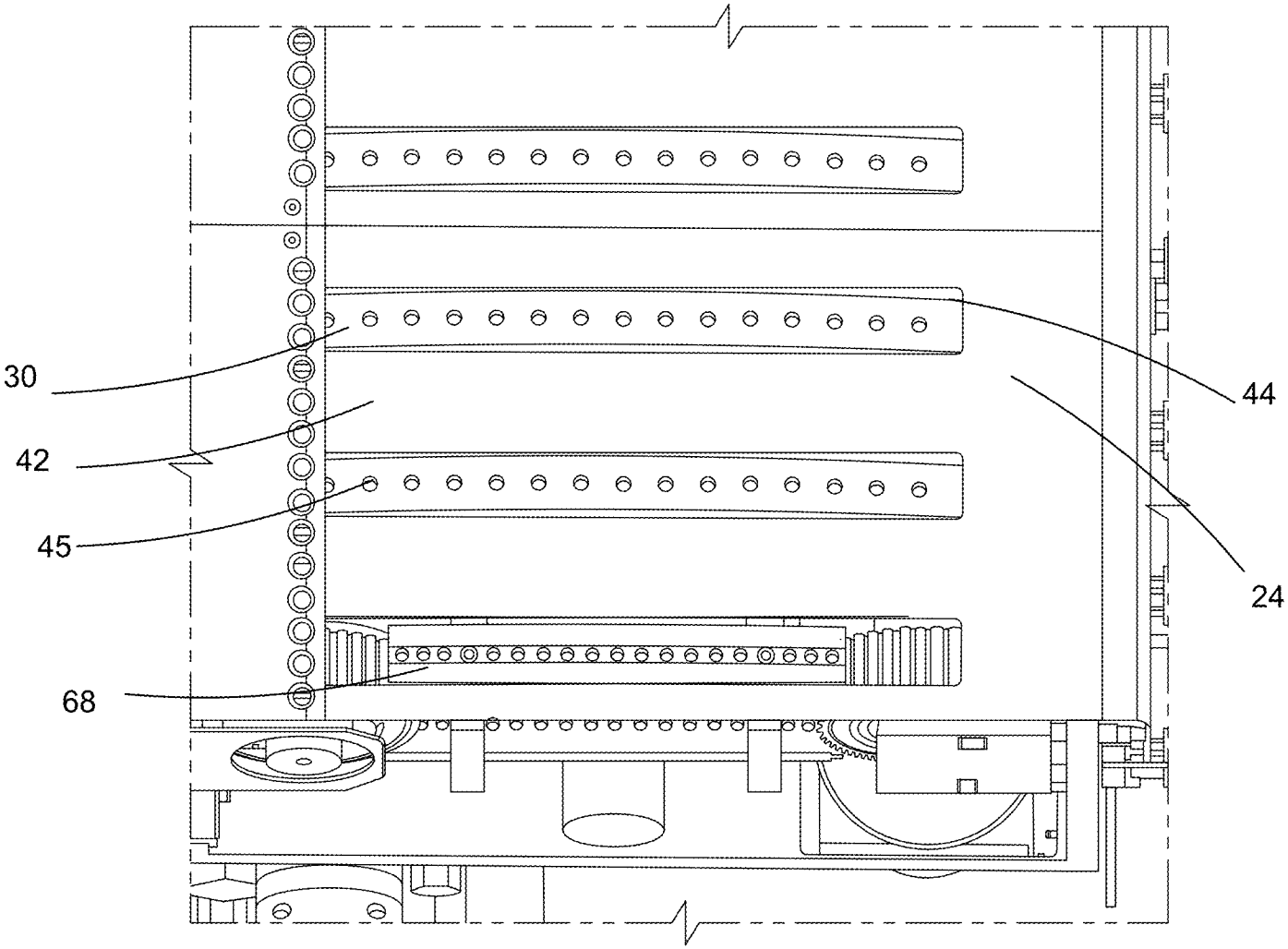
FIG. 5 is a top view, partially cut-away of the loading surface and the discharge mechanism according to an embodiment of the present invention.

As best seen in FIG. 5, the loading surface 24 comprises a plurality of elongated surfaces 42. The elongated surfaces 42 are spaced apart from each other in the lateral direction L, such that a slot 44 is formed in-between each elongated surface 42. The belt conveyors 30 are located in the slots 44.

As illustrated in FIGS. 4*a* and 4*b*, 5 and 7, the sheet discharge mechanism 26 comprises a plurality of belt conveyors 30, a belt guiding mechanism 48, and a belt displacement mechanism 50.

Each belt conveyor 30 is provided with an upper contact surface 52 which is in contact with the bottom surface of the sheets 2 and a return portion 54 which is located vertically below the contact surface 52. The upper contact portion 52 of the belt conveyors 30 is thus exposed to the sheet 2 in the elongated slots 44.

The belts conveyors 30 are movable in unison between a discharge position DP in which the contact surfaces 52 of the belt conveyors 30 are located vertically above the loading surface 24, and a clearing position CP in which the contact surfaces 52 of the belt conveyors 30 are located vertically below the loading surface 24. In the discharge position DP, the lowermost positioned sheet 2 in the stack S is brought into contact with the belt conveyors 30 which drive the sheet 2 forward in the direction of transportation T.

Each belt is mounted onto the belt guiding mechanism 48. The belt guiding mechanism 48 comprises a drive roller 56 and an idle roller 58 around which the belt is mounted. The drive roller 56 and the idle roller 58 are rotatably attached to the chassis of the feeder module 12 in a first bracket 60*a* and a second bracket 60*b*.

Figure 7:
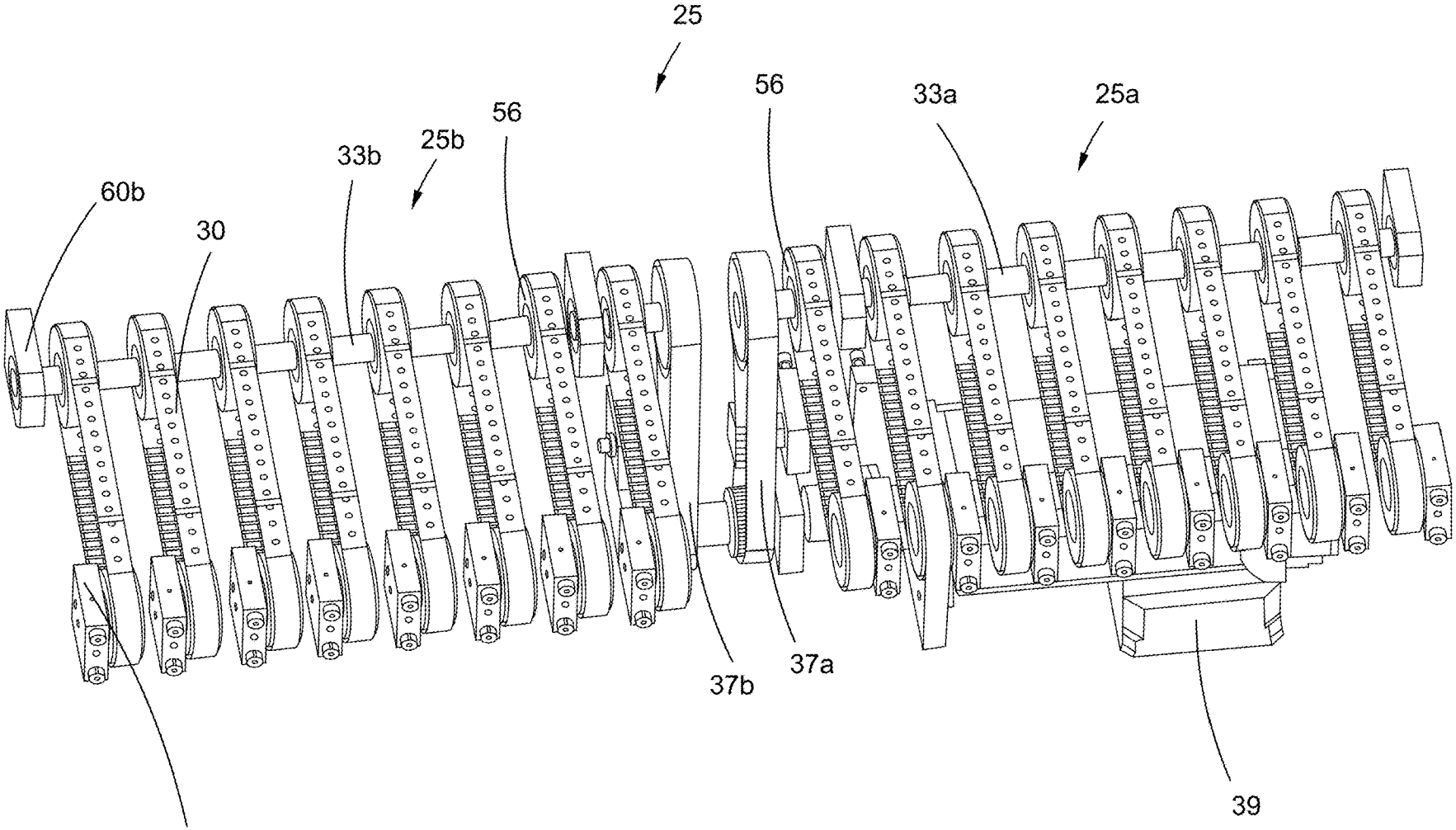
FIG. 7 is a schematic perspective view of belt assembly and driving mechanism according to an embodiment of the present invention.

The drive roller 56 may be connected to a drive shaft 62 which extends through the center of all drive rollers 56. In such a way, all the belt conveyors 30 are driven in unison. Alternatively, as best seen in FIG. 7, a discharge conveyor 25 comprises a first group 25*a* of belt conveyors 30 are connected to a first drive shaft member 33*a* and a second group 25*b* of belt conveyors 30 are connected to a second drive shaft member 33*b*. The first and second drive shaft members 33*a*, 33*b* may be connected to a common motor 39. Drive pulleys 37*a*, 37*b* may be arranged to inter-connect each drive shaft member 33*a*, 33*b* to the common motor 39.

The common motor may be located in the center under the loading surface 24. In another variant (non-illustrated), the motor may be located on opposite exterior lateral sides of the loading surface 24.

Hence, the driving connection from the motor 39 and to each respective drive shaft 33*a*, 33*b* can be located in the center of the loading surface. Alternatively, in a non-illustrated embodiment, two motors 39 can be provided and the driving connection between each motor 39 and each drive shaft 33*a*, 33*b* can be located at an exterior portion of the loading surface 24.

Preferably, the drive roller 56 and the idle roller 58 have the same diameter. In such a way, the trajectory of the belt conveyor is symmetric. The drive roller 56 and the idle roller 58 may be toothed and configured to engage with the inner dented surface of the belt conveyors 30.

Figure 4B:
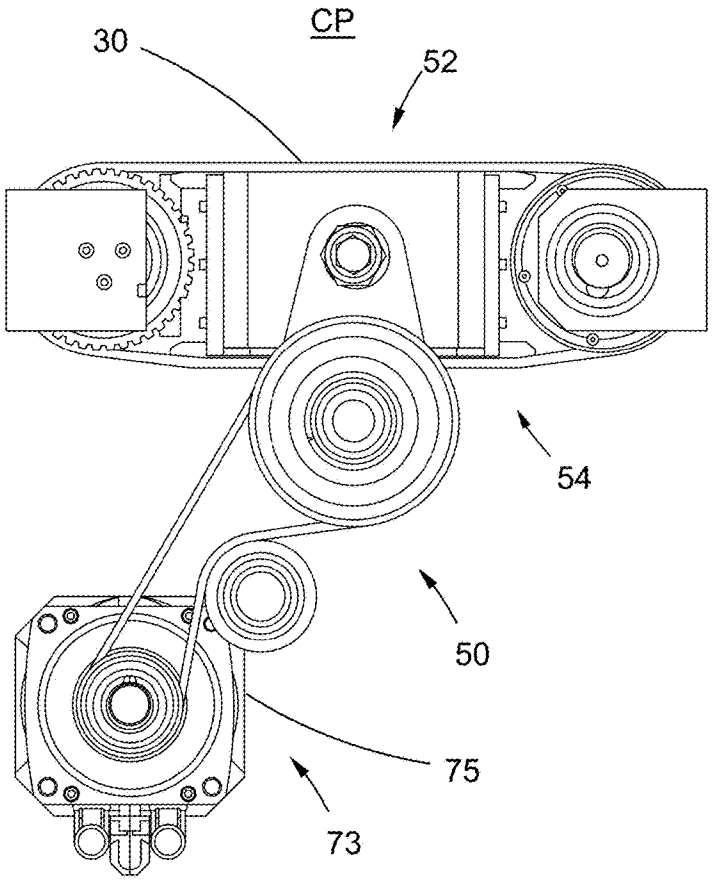
FIGS. 4*a* and 4*b* are side views of a discharge mechanism in a first position and second position, respectively.
Figure 4A:
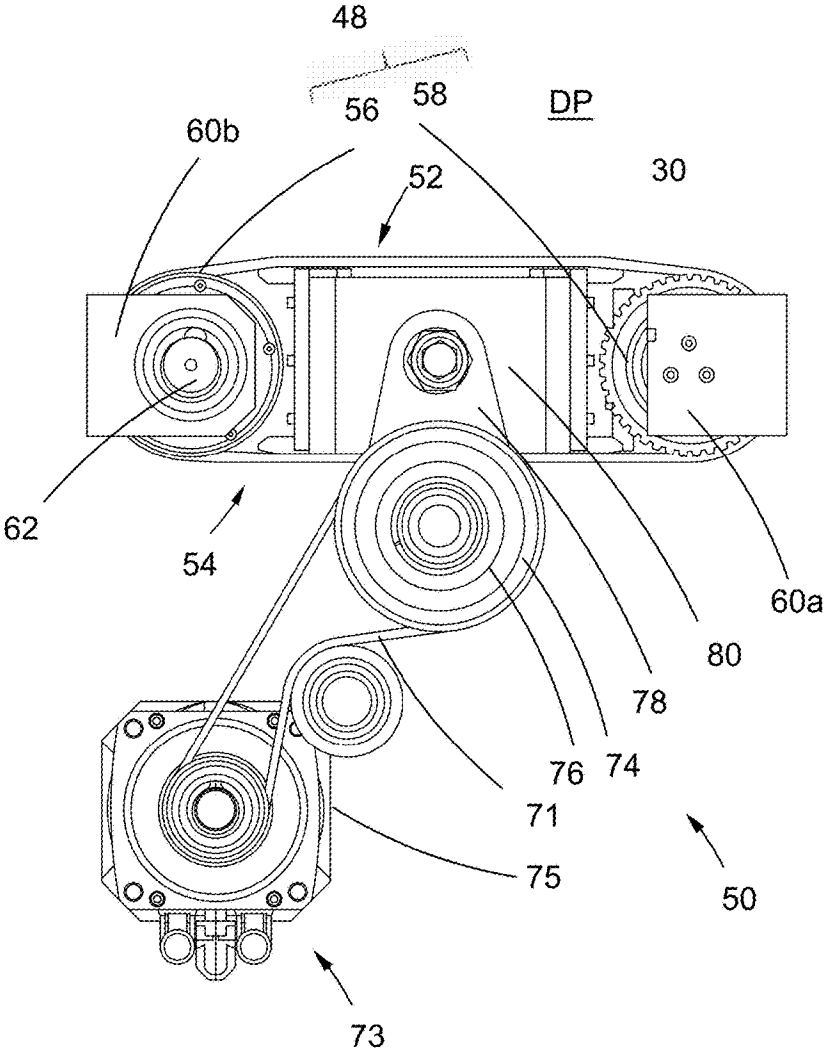
Figure 6:
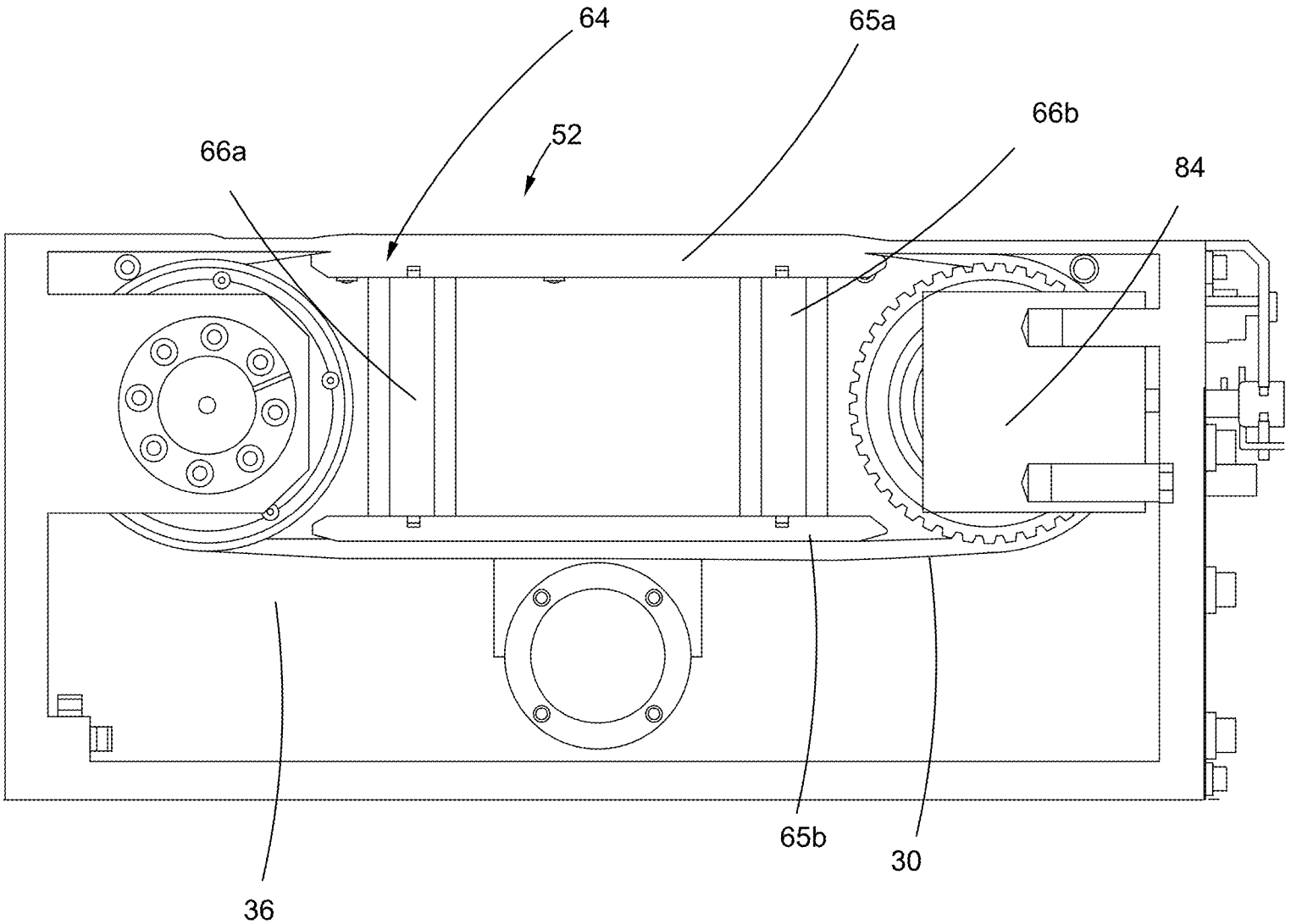
FIG. 6 is a cross-sectional view of the discharge mechanism of FIGS. 4 and 5.

As best seen in FIGS. 4*a*, 4*b* and 6, the belt displacement mechanism 50 comprises a displacement member 64 located inside an inner periphery of each belt conveyor 30. The displacement member 64 comprises an upper displacement surface 65*a* and a lower displacement surface 65*b*. The upper displacement surface 65*a* is configured to move the upper contact surface 52 of the belt conveyor 30 upwards. The lower displacement surface 65*b* of the displacement member 64 is configured to move the return portion 54 of the belt conveyor 30 vertically downwards.

The upper and lower displacement surfaces 65*a*, 65*b* are parallel to each other. The upper and lower displacement surfaces 65*a*, 65*b* may be horizontal. The upper and lower displacement surfaces 65*a*, 65*b* are preferably interconnected via at least one vertical member 66*a*, 66*b*. Preferably, a first vertical member 66*a* and a second vertical member 66*b* are provided. The at least one vertical member 66*a*, 66*b* may extend across the loading surface 24 such as to interconnect all upper and lower displacement surfaces 65*a*, 65*b* of all belt conveyors 30.

As illustrated in FIG. 5, at least the upper displacement surfaces 65*a* may be provided with apertures 68. In such a way, the airflow from the suction box can flow through the displacement member 64. The upper and lower displacement surfaces 65*a*, 65*b* may also be provided with a sliding surface configured to contact the belt conveyor 30. The sliding surface is a low friction surface, such as a smooth metallic surface. Additionally, the belt conveyors 30 may be provided with apertures 45.

The displacement mechanism 50 is moved in the vertical direction by a motor 75, a toothed drive roller 74, a pulley 71 and a timed mechanism 76. The timed mechanism may comprise an eccentric shaft 76. A first bracket 78 and a second bracket 80 connected the eccentric shaft 76 to the displacement member 64. As the eccentric shaft 76 rotates, the displacement member 64 moves up and down in the vertical direction V. The belt displacement member 64 is thus connected to a second motor 75, which is separate from the motor 39.

The upper and lower displacement surfaces 65*a*, 65*b* are positioned symmetrically with respect to the drive roller 56 and the idle roller 58. The displacement member 64 thus symmetrically supports the upper contact portion 52 and the return portion 54 of the belt conveyor 30. The up and down movement of the displacement member 64 is preferably at the same distance. This makes it possible to have the same variations in the length of the belt conveyors on either side of the displacement member and therefore to limit belt tension variations.

The invention claimed is:

1. A feeder module for discharging sheets into a converting machine, the feeder module comprising:

a loading surface configured to support a stack of sheets, and a movable discharge conveyor comprising a plurality of belt conveyors, wherein each belt conveyor comprises an upper contact surface configured to enter into contact with the sheets and a return portion located vertically below the upper contact surface, wherein the belt conveyors are configured to move between a discharge position in which the belt conveyors are contacting the lowermost positioned sheet in the stack and discharges said sheet, and a clearing position in which the belt conveyors are located underneath the loading surface, wherein each of the belt conveyors is guided by a motorized drive roller and an idle roller, wherein the motorized drive rollers are mounted to a drive shaft, wherein a belt displacement member is arranged between the drive roller and the idle roller, and wherein the belt displacement member is configured to move the belt conveyors up and down in the vertical direction, wherein the belt displacement member comprises an upper displacement surface configured to move the contact surface of the conveyor belt upwards, and a lower displacement surface configured to move the return portion of the belt conveyor belt downwards, and wherein the upper displacement surface is provided with apertures.

2. The feeder module according to claim 1, wherein the drive shaft comprises a first drive shaft member and a second drive shaft member, and wherein a first group of belt conveyors is connected to the first drive shaft member and a second group of belt conveyors is connected to the second drive shaft member.

3. The feeder module according to claim 1, wherein the belt displacement member is arranged inside a loop formed by the belt conveyor and wherein the belt displacement member is configured to contact an inner periphery of the belt conveyor.

4. The feeder module according to claim 1, wherein the upper and lower displacement surfaces are provided with a sliding surface configured to contact an inner periphery of the belt conveyor.

5. The feeder module according to claim 1, wherein the belt displacement member is connected to a second drive mechanism, and wherein the second drive mechanism comprises a second motor and a timed mechanism.

6. The feeder module according to claim 5, wherein the timed mechanism is an eccentric drive shaft.

7. The feeder module according to claim 2, wherein the feeder module further comprises:

a suction box provided with a plurality of suction compartments, and wherein the first and second drive shaft members are located in the suction box, and wherein the suction compartments are symmetrically arranged in relation to a center axis of the loading surface.

* * * * *